US008858249B2

(12) United States Patent
Honda

(10) Patent No.: US 8,858,249 B2
(45) Date of Patent: Oct. 14, 2014

(54) CONNECTOR HAVING A CAM OPERATING PORTION WHICH PRESSES A CONNECTION OBJECT WITH BEING ROTATED

(75) Inventor: Yosuke Honda, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 268 days.

(21) Appl. No.: 13/405,872

(22) Filed: Feb. 27, 2012

(65) Prior Publication Data

US 2012/0315791 A1 Dec. 13, 2012

(30) Foreign Application Priority Data

Jun. 8, 2011 (JP) ..... 2011-127856

(51) Int. Cl.
*H01R 12/24* (2006.01)

(52) U.S. Cl.
USPC .... 439/260; 439/495; 439/607.32; 439/607.4

(58) Field of Classification Search
USPC ..... 439/260, 495, 497, 607.32, 607.35, 439/607.36, 607.4
See application file for complete search history.

(56) References Cited

U.S. PATENT DOCUMENTS 3,689,865 A * 9/1972 Pierini et al. ..... 439/60
4,509,811 A * 4/1985 Amano et al. ..... 439/77
4,687,267 A * 8/1987 Header et al. ..... 439/62
5,605,463 A * 2/1997 MacGregor et al. ..... 439/64
5,716,229 A * 2/1998 Loder et al. ..... 439/493
5,738,545 A * 4/1998 Igarashi et al. ..... 439/607.36
5,846,097 A * 12/1998 Marian, Jr. ..... 439/289
5,882,223 A * 3/1999 Igarashi ..... 439/495
5,896,274 A * 4/1999 Ishida ..... 361/737
5,897,393 A * 4/1999 Haftmann ..... 439/495
6,027,366 A * 2/2000 Mori et al. ..... 439/495
6,203,346 B1 * 3/2001 Wu et al. ..... 439/260
6,315,616 B1 * 11/2001 Hayashi ..... 439/638
6,386,905 B1 * 5/2002 Ito ..... 439/495
6,390,850 B2 * 5/2002 Yoshimura et al. ..... 439/607.22

(Continued)

FOREIGN PATENT DOCUMENTS

CN 201466267 U1 5/2010
JP 10-206701 A 8/1998

(Continued)

OTHER PUBLICATIONS

Korean Office Action mailed on Mar. 27, 2013 in Korean Application No. 2012-0030578 with English translation.

(Continued)

*Primary Examiner* — Neil Abrams
(74) *Attorney, Agent, or Firm* — Collard & Roe, P.C.

(57) ABSTRACT

Provided is a connector including a plug and a receptacle which are adapted to be fitted together. The plug includes a plate-like or sheet-like connection object, a ground shell which is disposed on one surface side of the connection object so as to be spaced apart therefrom, and a guide covering front end portions of the connection object and the ground shell. The receptacle includes contacts and an actuator having a cam operating portion which is made of a material different from that of the ground shell. When the actuator is operated in a state where the plug and the receptacle are fitted together, the cam operating portion is rotated on the ground shell to press the connection object onto the contacts.

9 Claims, 7 Drawing Sheets

(56) References Cited

U.S. PATENT DOCUMENTS

| | | | | |
|---|---|---|---|---|
| 6,464,536 | B1 * | 10/2002 | Kobayashi | 439/607.22 |
| 6,565,389 | B1 * | 5/2003 | Igarashi | 439/660 |
| 6,676,444 | B2 * | 1/2004 | Noro | 439/579 |
| 6,830,478 | B1 * | 12/2004 | Ko | 439/579 |
| 7,077,691 | B2 * | 7/2006 | Yokoo et al. | 439/495 |
| 7,094,092 | B2 * | 8/2006 | Yang | 439/495 |
| 7,134,907 | B2 * | 11/2006 | Watanabe et al. | 439/495 |
| 7,134,912 | B2 * | 11/2006 | Kamata et al. | 439/607.31 |
| 7,201,605 | B2 * | 4/2007 | Yamada et al. | 439/495 |
| 7,309,237 | B2 * | 12/2007 | Kuo | 439/63 |
| 7,354,300 | B2 * | 4/2008 | Shindo | 439/497 |
| 7,422,472 | B2 * | 9/2008 | Hashiguchi et al. | 439/495 |
| 7,520,774 | B2 * | 4/2009 | Watanabe | 439/493 |
| 7,597,584 | B2 * | 10/2009 | Yamaji | 439/495 |
| 7,674,134 | B2 * | 3/2010 | Yamaji et al. | 439/607.53 |
| 7,695,311 | B2 * | 4/2010 | Nemoto | 439/495 |
| 7,705,248 | B2 | 4/2010 | Loeffelholz et al. | |
| 7,993,151 | B2 * | 8/2011 | Chuo et al. | 439/260 |
| 8,342,869 | B2 * | 1/2013 | Okamura | 439/260 |
| 8,465,324 | B2 * | 6/2013 | Ikari et al. | 439/607.31 |
| 8,550,849 | B2 * | 10/2013 | Yamaji | 439/607.41 |
| 8,622,766 | B2 * | 1/2014 | Yokoo et al. | 439/495 |
| 2003/0168234 | A1 | 9/2003 | Loeffelholz et al. | |
| 2006/0172590 | A1 | 8/2006 | Yamada et al. | |
| 2012/0171890 | A1 * | 7/2012 | Kurachi | 439/372 |

FOREIGN PATENT DOCUMENTS

| | | | |
|---|---|---|---|
| JP | 2005-519483 | A | 6/2005 |
| JP | 2006-128018 | | 5/2006 |
| KR | 2010-0109430 | A | 10/2010 |
| TW | M400695 | U1 | 3/2011 |

OTHER PUBLICATIONS

Taiwanese Office Action dated Apr. 17, 2014, with English translation.

Chinese Office Action in Application No. 201210080669.7 dated May 20, 2014, with English translation.

* cited by examiner

CONNECTOR HAVING A CAM OPERATING PORTION WHICH PRESSES A CONNECTION OBJECT WITH BEING ROTATED

This application is based upon and claims the benefit to priority from Japanese patent application No. 2011-127856, filed on Jun. 8, 2011, the disclosure of which is incorporated herein in its entirety by reference.

TECHNICAL FIELD

This invention relates to a connector utilizing a plate-like or sheet-like connection object.

BACKGROUND ART

Conventionally, there has been known a plate-like or sheet-like connection object called FPC (Flexible Printed Circuit) or FFC (Flexible Flat Cable). Further, various techniques have been proposed for obtaining a predetermined connection by operating an actuator after inserting this kind of connection object (see, e.g. Patent Document 1: JP-A-2006-128018).

Referring to FIG. 1, a technique entitled "Connector" as disclosed in Patent Document 1 will be briefly explained.

A flexible board connector 1 comprises a housing 2, contacts 3, and an actuator 4. Each contact 3 has a fixing portion 3*a* fixed to the housing 2, a movable portion 3*b*, and a connecting portion 3*c* connecting the movable portion 3*b* to the fixing portion 3*a* to make the movable portion 3*b* movable. The movable portion 3*b* has a recess 3*d* and a contact point 3*e* facing each other. The housing 2 has a wall portion 2*a* disposed between the recesses 3*d* and the contact points 3*e*. The actuator 4 has a camshaft 4*a* disposed in the recesses 3*d*. Although not clarified in Patent Document 1, the housing 2 and the actuator 4 may be made of the same kind of material such as plastic.

The actuator 4 is set in an open state shown in FIG. 1(*a*) and then an FPC 5 is inserted between the wall portion 2*a* and the contacts 3*e* as shown in FIG. 1(*b*). In this open state, a force required for insertion of the FPC 5 can be designed to be substantially zero. Thereafter, the actuator 4 is rotated in a clockwise direction so as to be set in a closed state shown in FIG. 1(*c*). While the actuator 4 is rotated, a cam operating portion (although not given a reference symbol in FIG. 1 quoted from Patent Document 1, a portion which serves as a cam on the side opposite to the side where the actuator 4 is operated by a finger) of the actuator 4 is rotated on the wall portion 2*a* to raise the movable portions 3*b*. As a result, the contact points 3*e* are pressed onto the FPC 5 so that the FPC 5 is electrically connected to the contacts 3.

As described above, the insertion of the FPC 5 is easy and, further, by the simple operation of rotating the actuator 4, the predetermined connection can be obtained.

SUMMARY OF THE INVENTION

However, in the case where the housing 2 and the actuator 4 are both made of plastic in FIG. 1, when the cam operating portion of the actuator 4 slides on the wall portion 2*a* during the operation of the actuator 4, abrasion powder of the plastic tends to be generated. There is a possibility that the generated abrasion powder causes contact failure between the contacts 3 and the FPC 5.

Further, due to the thickness variation of the FPC 5 within tolerance, the contact load for fitting between the contacts 3 and the FPC 5 tends to change and thus the contact stability is not obtained.

It is therefore an exemplary object of this invention to provide a connector with reduced contact failure and enhanced contact stability.

Other objects of this invention will become clear as the description proceeds.

According to an exemplary aspect of the present invention, there is provided a connector which comprises a plug and a receptacle which are adapted to be fitted together, wherein the plug comprises a plate-like or sheet-like connection object, a ground shell which is disposed on one surface side of the connection object so as to be spaced apart from the connection object, and a guide covering front end portions of the connection object and the ground shell, and wherein the receptacle comprises a contact and an actuator having a cam operating portion which is made of a material different from that of the ground shell and, when the actuator is operated in a state where the plug and the receptacle are fitted together, the cam operating portion is rotated on the ground shell to press the connection object onto the contact.

EXEMPLARY EMBODIMENT

Figure 1:
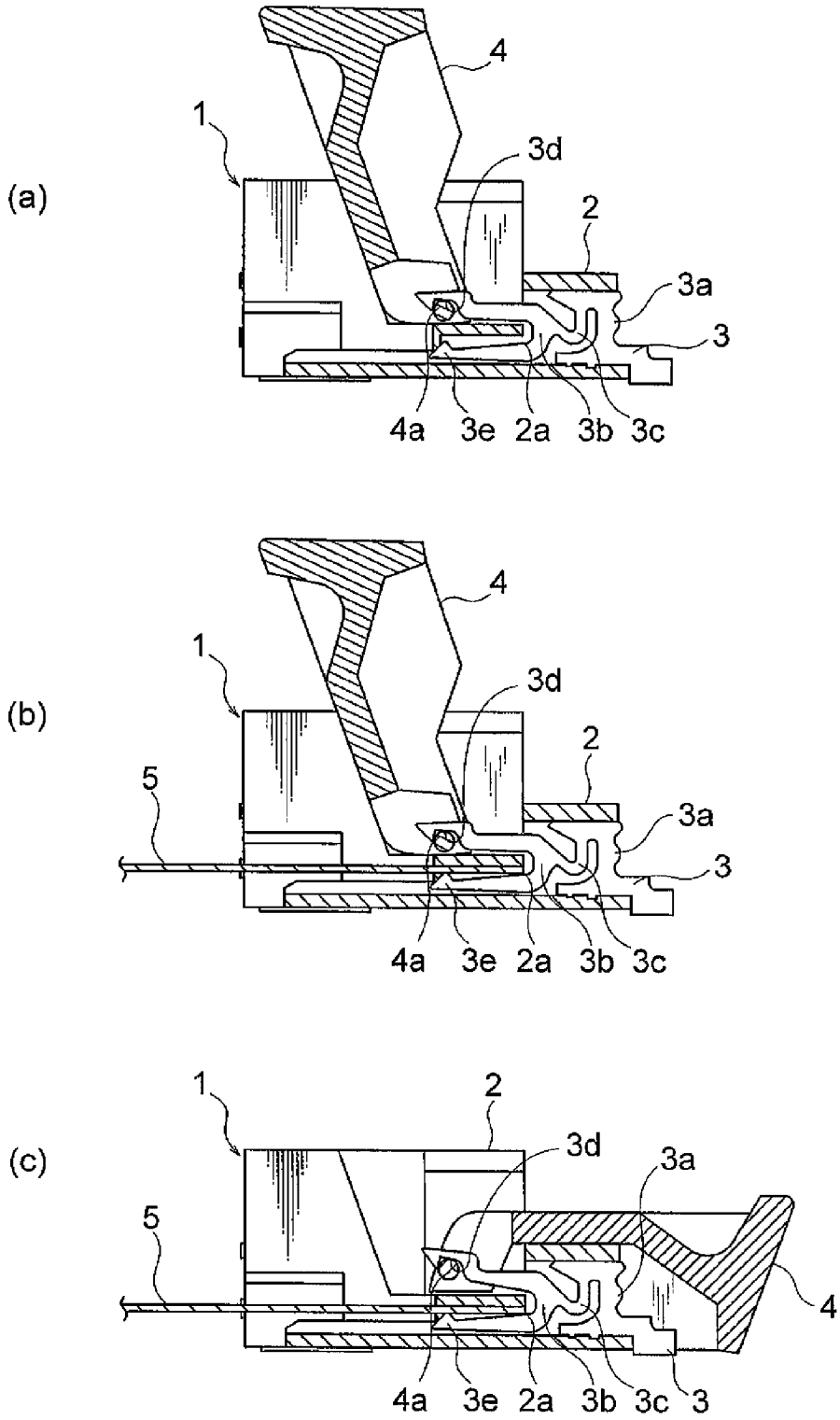
FIG. 1 (PRIOR ART)
FIG. 1 shows diagrams for explaining a technique disclosed in Patent Document 1 (JP-A-2006-128018), wherein (a) is a cross-sectional view showing a state before an FPC is inserted into a flexible board connector, (b) is a cross-sectional view showing a state where the FPC is inserted in the flexible board connector, and (c) is a cross-sectional view showing a state where the FPC is connected to the flexible board connector.

With reference to the drawing, description will be made as regards a connector according to an exemplary embodiment of this invention.

Figure 2:
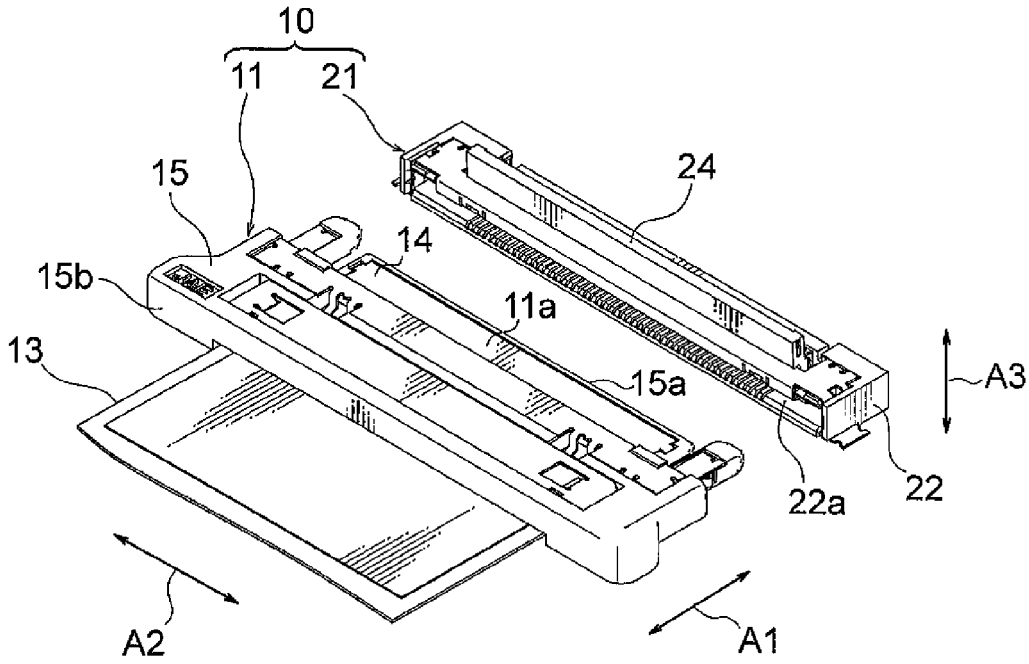
FIG. 2 is a perspective view showing a non-fitted state of a plug and a receptacle in a connector according to an embodiment of this invention.
Figure 3:
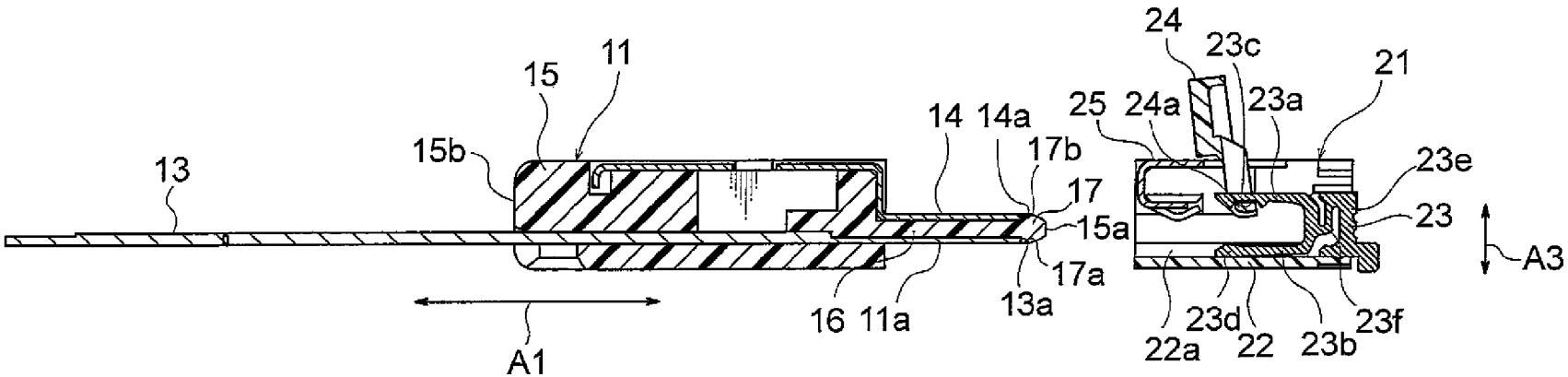
FIG. 3 is a cross-sectional view of the state of FIG. 2.

Referring first to FIGS. 2 and 3, a connector 10 is a combination of a plug 11 and a receptacle 21 that are fittable to each other in a predetermined direction, i.e. a first direction A1. In FIGS. 2 and 3, the plug 11 and the receptacle 21 are in a non-fitted state.

The plug 11 comprises a plate-like or sheet-like connection object 13 spreading in the first direction A1 and a second direction A2 perpendicular to the first direction A1, a ground shell 14 in the form of a metal plate which is disposed on one surface side (upper surface side in FIG. 3), in a third direction A3 perpendicular to the first and second directions A1 and A2, of the connection object 13 so as to be spaced apart therefrom, and a plastic insulator 15 fixing them together. Specifically, part of the connection object 13 is fixed by in-molding when the insulator 15 is formed into a predetermined shape and, further, the ground shell 14 is fixedly attached to an outer surface of the insulator 15.

One end, in the first direction A1, of the insulator 15 is called a front end 15*a* while its opposite end is called a rear end 15*b*. The dimension, in the third direction A3, of the insulator 15, i.e. the thickness thereof, is set to be relatively small on the front end 15*a* side while it is set to be relatively large on the rear end 15*b* side. On the front end 15*a* side, the insulator 15 has a plate-like portion 16 interposed between the connection object 13 and the ground shell 14. A front end face 13*a* of the connection object 13 and a front end face 14*a* of the ground shell 14 are disposed so as to be substantially flush with each other in the third direction A3.

The connection object 13 has, at least at its portion facing the plate-like portion 16 of the insulator 15, a signal layer formed by a number of conductors (not illustrated) which are arranged in parallel in the second direction A2. These conductors are exposed on the opposite surface side (lower surface side in FIG. 3) of the connection object 13 in the vicinity of the front end face 13*a*. Although an FPC is illustrated as the connection object 13 herein, an FFC may of course be used instead.

The ground shell 14 has, at least at its portion facing the plate-like portion 16 of the insulator 15, a ground layer which extends in the second direction A2 equally to or longer than the dimension of the connection object 13. That is, the ground shell 14 is formed so as to face all the conductors of the connection object 13 in the third direction A3.

The insulator 15 further has a guide 17 which projects forward from the plate-like portion 16 more than the connection object 13 and the ground shell 14 and which covers the front end portions, i.e. the front end faces 13*a* and 14*a*, of them. Specifically, the guide 17 has a first portion 17*a* covering the front end face 13*a* of the connection object 13 and a second portion 17*b* covering the front end face 14*a* of the ground shell 14. A front end of each of the first and second portions 17*a* and 17*b* is formed as an inclined surface or a curved surface.

in this manner, the plug 11 is formed with a plate-like fitting portion 11*a* spreading in the first and second directions A1 and A2.

On the other hand, the receptacle 21 comprises a plastic housing 22 which is elongated in the second direction A2, a number of metal contacts 23 received in the housing 22, an actuator 24 made of a plastic material which is thus different from the material of the ground shell 14, and a receptacle-side metal shell 25 attached to a front upper portion of the housing 22. The actuator 24 has a cam operating portion 24*a* which serves as a cam on the side opposite to a portion, adapted to be operated by a finger, of the actuator 24.

The housing 22 has, at its front portion, a fitting opening 22*a* for fitting therein the plug 11. The fitting opening 22*a* is formed to be elongated in the second direction A2 along the housing 22.

The contacts 23 are arranged in parallel in the second direction A2 at positions corresponding to the fitting opening 22*a*. Each contact 23 has an upper jaw portion 23*a* located in the upper part of the fitting opening 22*a* and a lower jaw portion 23*b* located in the lower part of the fitting opening 22*a*. The upper jaw portion 23*a* and the lower jaw portion 23*b* are integrally joined together to form a movable portion. The upper jaw portion 23*a* has a recess 23*c* facing downward and the lower jaw portion 23*b* has a contact point 23*d* with an upward projection. A substantial distance between the upper jaw portion 23*a* and the lower jaw portion 23*b* (herein, this is called a "contact opening") is designed to be greater than the thickness of the fitting portion 11*a* of the plug 11. That is, each contact 23 is a so-called ZIF (Zero Insertion Force) type contact which is designed so that the insertion force of the fitting portion 11*a* of the plug 11 becomes zero.

Each contact 23 further has a to-be-held portion 23*e* held by the housing 22 and a flexible connecting portion 23*f* connecting the upper jaw portion 23*a* and the lower jaw portion 23*b* to the to-be-held portion 23*e*. In this way, the connecting portion 23*f* makes the upper jaw portion 23*a* and the lower jaw portion 23*b* movable in the housing 22.

The actuator 24 is pivotally or rotatably engaged with the housing 22. The cam operating portion 24*a* of the actuator 24 is disposed in the recesses 23*c* of the upper jaw portions 23*a*. Therefore, when the actuator 24 is rotated, the cam operating portion 24*a* is rotated in the recesses 23*c*. The operation caused by the rotation of the cam operating portion 24*a* will be clarified later.

When fitting the plug 11 into the receptacle 21, the fitting portion 11*a* of the plug 11 is inserted into the fitting opening 22*a* formed in the housing 22 of the receptacle 21. Since the contact opening is designed to be greater than the thickness of the fitting portion 11*a* of the plug 11, the operation of fitting the plug 11 into the receptacle 21 is easy.

Even if the fitting portion 11*a* is brought into contact with the upper jaw portions 23*a* or the lower jaw portions 23*b* of the contacts 23 on the way of fitting into the fitting opening 22*a*, since the plastic guide 17 is brought into contact with them, no collision between the metals occurs. Even if the fitting portion 11*a* further moves into the fitting opening 22*a* to abut the vicinity of the connecting portions 23*f* of the contacts 23, no collision between the metals occurs likewise. As a consequence, there is no possibility that metal abrasion powder is generated due to collision between the metals to cause an electrical short when the plug 11 is fitted into the receptacle 21.

Since the front end faces 13*a* and 14*a* of the connection object 13 and the ground shell 14 are covered with the guide 17, even if the fitting portion 11*a* of the plug 11 collides with any portion of the receptacle 21 in the fitting operation, the possibility is low that the connection object 13 or the ground shell 14 is damaged.

Figure 4:
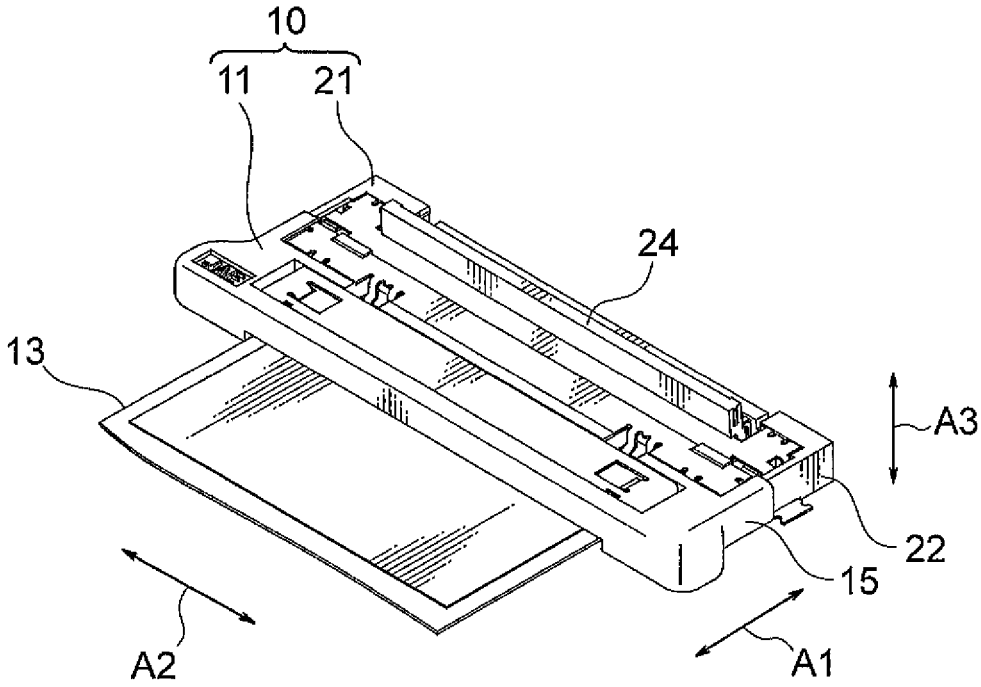
FIG. 4 is a perspective view showing a state where while the plug and the receptacle in the connector of FIG. 2 are in a fitted state, signal lines are in a non-connected state.
Figure 5:
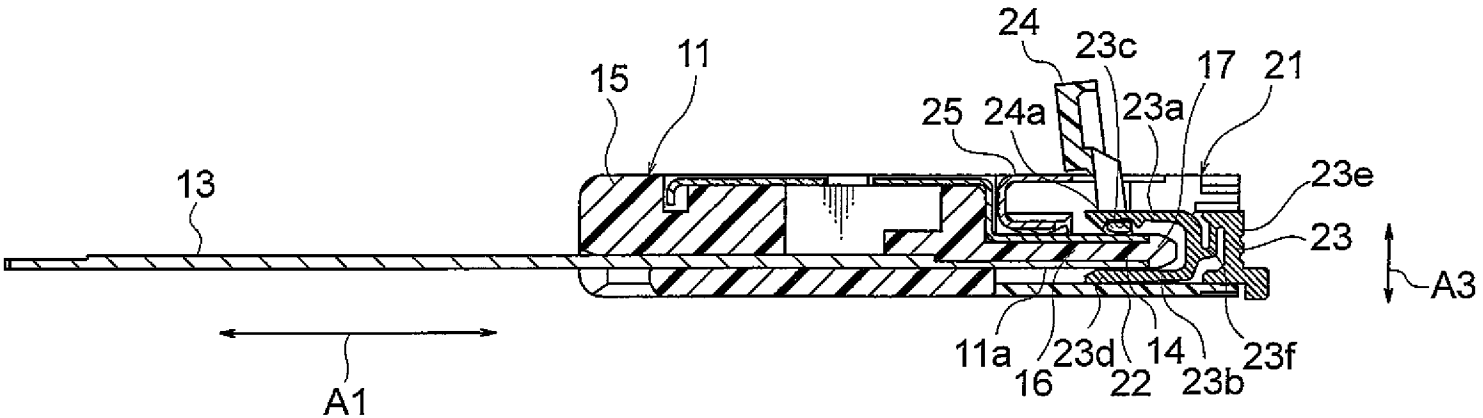
FIG. 5 is a cross-sectional view of the state of FIG. 4.

When the plug 11 and the receptacle 21 are completely fitted together, the state of FIGS. 4 and 5 is obtained. In FIGS. 4 and 5, the ground shell 14 of the plug 11 faces the upper jaw portions 23*a*, particularly the recesses 23*c* thereof, of the contacts 23 so that the cam operating portion 24*a* of the actuator 24 is disposed between the upper jaw portions 23*a* and the ground shell 14. Since the connection object 13 and the contacts 23 are not yet normally connected together, signal lines can be said to be in a non-connected state, while, since the receptacle-side shell 25 and the ground shell 14 are in contact with each other, grounding is connected.

Figure 6:
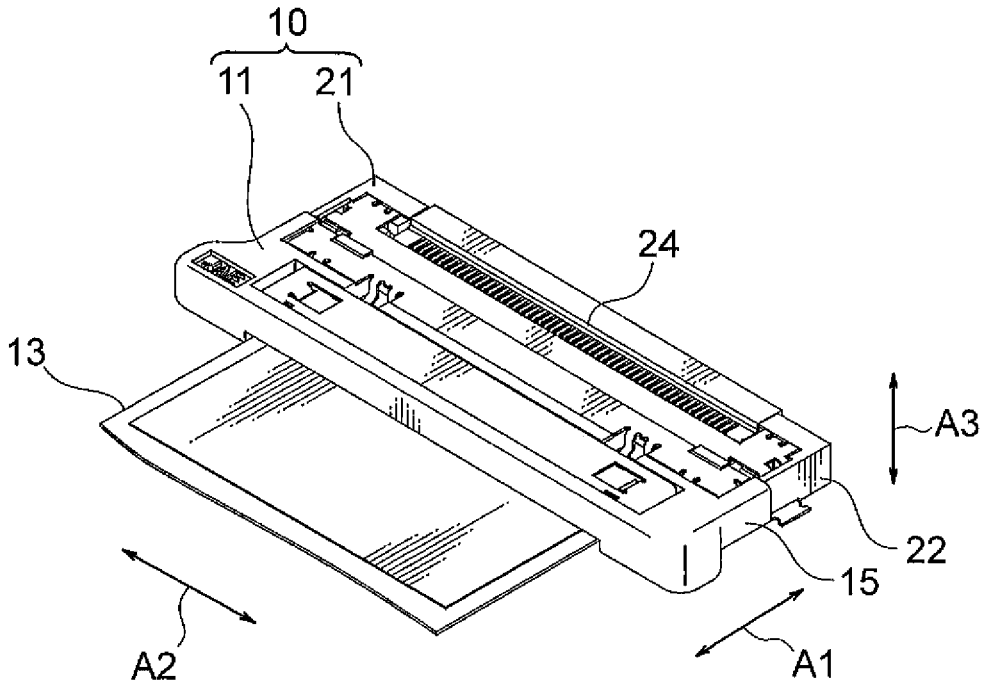
FIG. 6 is a perspective view showing a normal connection state of the plug and the receptacle in the connector of FIG. 2.
Figure 7:
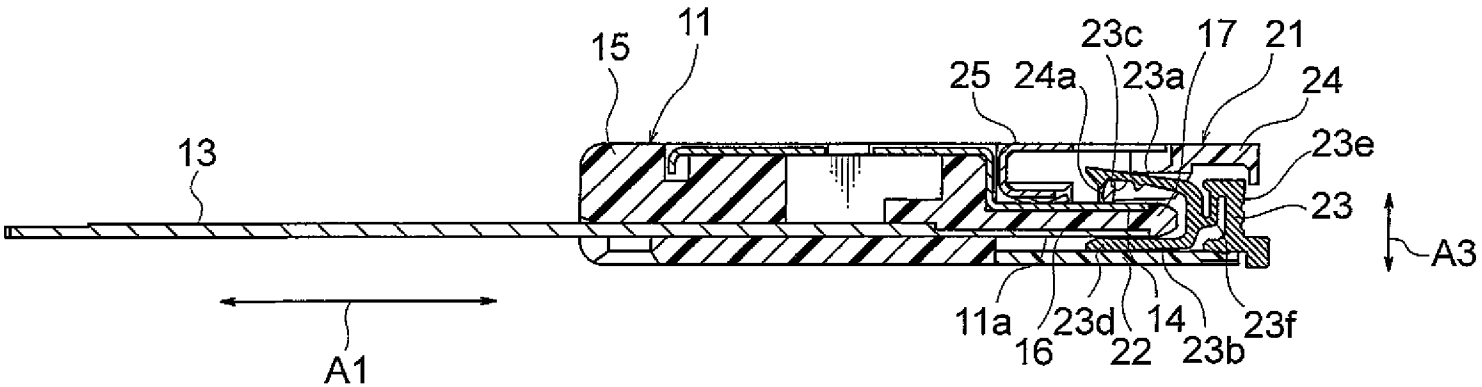
FIG. 7 is a cross-sectional view of the state of FIG. 6.

Then, the actuator 24 is operated to rotate in a clockwise direction in FIG. 5. As a consequence, the state of FIGS. 6 and 7 is obtained. Following the rotation of the actuator 24, the cam operating portion 24*a* is rotated on the ground shell 14 to give a mutually separating force to the upper jaw portions 23*a* of the contacts 23 and the fitting portion 11*a* of the plug 11. That is, the push-up force is exerted on the upper jaw portions 23*a* of the contacts 23. As a result, the lower jaw portions 23*b* of the contacts 23 are raised so that the contact points 23*d* are pressed onto the connection object 13. In this event, since the push-down force is exerted on the fitting portion 11*a* of the plug 11, the contacts 23 are electrically connected to the connection object 13 through the contact points 23*d*. Accordingly, grounding is connected and further the signal lines are connected so that a normal connection state of the plug 11 and the receptacle 21 is obtained.

When the actuator 24 is operated, since the plastic cam operating portion 24*a* is rotated on the metal ground shell 14, this causes a sliding between the different kinds of materials so that the coefficient of friction is small as compared with a sliding between plastics. Therefore, it is possible to reduce the generation of abrasion powder.

Since the fitting portion 11*a* of the plug 11 has a structure in which the connection object 13, the plate-like portion 16, and the ground shell 14 are stacked together, the contact opening in the receptacle 21 is designed to be large corresponding thereto so that each contact 23 as a whole has a flexible spring structure, and therefore, high contact reliability is obtained even with the thickness variation of the connection object 13. As a consequence, it is possible to easily cope with the thickness variation of the connection object 13 within tolerance to thereby enhance the contact stability.

As described above, according to the connector 10, since the cam operating portion 24*a* of the actuator 24 is rotated on the ground shell 14 which is made of the material different from that of the cam operating portion 24*a*, it is possible to make the coefficient of friction small to thereby reduce the generation of abrasion powder and, further, it is possible to easily cope with the thickness variation of the connection object 13 within tolerance to thereby enhance the contact stability.

While the description has been given of the case where the so-called ZIF type contact which is designed so that the insertion force of the fitting portion 11*a* of the plug 11 becomes zero is used as each contact 23, use may alternatively be made of a so-called LIF (Low Insertion Force) type contact which is designed so that the insertion force of the fitting portion 11*a* of the plug 11 is reduced.

This invention is not limited to the above-mentioned embodiment and a part or the whole thereof can also be described as the following supplementary notes but is not limited thereto.

(Supplementary Note 1)

A connector comprising a plug and a receptacle which are adapted to be fitted together, wherein the plug comprises a plate-like or sheet-like connection object, a ground shell which is disposed on one surface side of the connection object so as to be spaced apart from the connection object, and a guide covering front end portions of the connection object and the ground shell, and wherein the receptacle comprises a contact and an actuator having a cam operating portion which is made of a material different from that of the ground shell and, when the actuator is operated in a state where the plug and the receptacle are fitted together, the cam operating portion is rotated on the ground shell to press the connection object onto the contact.

(Supplementary Note 2)

The connector according to supplementary note 1, wherein the cam operating portion is made of a plastic and the ground shell is made of a metal.

(Supplementary Note 3)

The connector according to supplementary note 1 or 2, wherein the plug further comprises an insulator interposed between the connection object and the ground shell, and wherein the guide is integrally formed with the insulator.

(Supplementary Note 4)

The connector according to any one of supplementary notes 1 to 3, wherein the contact has an upper jaw portion that faces the ground shell when the plug and the receptacle are fitted together, and wherein the cam operating portion is disposed between the upper jaw portion and the ground shell.

(Supplementary Note 5)

The connector according to supplementary note 4, wherein the contact has a lower jaw portion that faces an opposite surface of the connection object when the plug and the receptacle are fitted together, and wherein the lower jaw portion has a contact point for contact with the connection object.

(Supplementary Note 6)

The connector according to supplementary note 5, wherein the receptacle further comprises a housing receiving therein the contact, and wherein the contact further has a to-be-held portion held by the housing and a flexible connecting portion connecting the upper jaw portion and the lower jaw portion to the to-be-held portion so that the connecting portion makes the upper jaw portion and the lower jaw portion movable in the housing.

(Supplementary Note 7)

The connector according to supplementary note 6, wherein the receptacle further comprises a receptacle-side shell attached to the housing, and wherein when the plug is inserted into the receptacle, the ground shell is brought into contact with the receptacle-side shell.

(Supplementary Note 8)

The connector according to any one of supplementary notes 1 to 7, wherein the contact is of a LIF type.

(Supplementary Note 9)

The connector according to any one of supplementary notes 1 to 7, wherein the contact is of a ZIF type.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A connector comprising a plug and a receptacle which are adapted to be fitted together, wherein the plug comprises a plate-like or sheet-like connection object, a ground shell which is disposed on one surface side of the connection object so as to be spaced apart from the connection object, and a guide covering front end portions of the connection object and the ground shell, and wherein the receptacle comprises a contact and an actuator having a cam operating portion which is made of a material different from that of the ground shell and, when the actuator is operated in a state where the plug and the receptacle are fitted together, the cam operating portion is rotated on the ground shell to press the connection object onto the contact.

2. The connector according to claim 1, wherein the cam operating portion is made of a plastic and the ground shell is made of a metal.

3. The connector according to claim 1, wherein the plug further comprises an insulator interposed between the connection object and the ground shell, and wherein the guide is integrally formed with the insulator.

4. The connector according to claim 1, wherein the contact has an upper jaw portion that faces the ground shell when the plug and the receptacle are fitted together, and wherein the cam operating portion is disposed between the upper jaw portion and the ground shell.

5. The connector according to claim 4, wherein the contact has a lower jaw portion that faces an opposite surface of the connection object when the plug and the receptacle are fitted together, and wherein the lower jaw portion has a contact point for contact with the connection object.

6. The connector according to claim 5, wherein the receptacle further comprises a housing receiving therein the contact, and wherein the contact further has a to-be-held portion held by the housing and a flexible connecting portion connecting the upper jaw portion and the lower jaw portion to the to-be-held portion so that the connecting portion makes the upper jaw portion and the lower jaw portion movable in the housing.

7. The connector according to claim 6, wherein the receptacle further comprises a receptacle-side shell attached to the housing, and wherein when the plug is inserted into the receptacle, the ground shell is brought into contact with the receptacle-side shell.

8. The connector according to claim 1, wherein the contact is of a LIF type.

9. The connector according to claim 1, wherein the contact is of a ZIF type.

* * * * *